United States Patent [19]

Drutchas et al.

[11] 4,080,124

[45] Mar. 21, 1978

[54] OPTIMUM PORTING CONFIGURATION FOR A SLIPPER SEAL PUMP

[75] Inventors: Gilbert H. Drutchas, Birmingham; George A. Berman, Huntington Woods, both of Mich.

[73] Assignee: TRW Inc., Cleveland, Ohio

[21] Appl. No.: 520,497

[22] Filed: Nov. 4, 1974

[51] Int. Cl.[2] ..... F01C 1/00; F04C 1/00

[52] U.S. Cl. ..... 418/267

[58] Field of Search ..... 418/266–268, 418/225, 150

[56] References Cited

U.S. PATENT DOCUMENTS

| | | | |
|---|---|---|---|
| Re. 27,241 | 12/1971 | Pace et al. | 418/268 |
| 3,424,094 | 1/1969 | Clark et al. | 418/267 |
| 3,781,145 | 12/1973 | Wilcox | 418/268 |
| 3,785,758 | 1/1974 | Adams et al. | 418/268 |
| 3,797,977 | 3/1974 | Carlson | 418/268 |

*Primary Examiner*—John J. Vrablik

[57] ABSTRACT

A slipper vane seal pump has a porting plate and pumping chamber combination having optimum slipper seal porting configuration so that in a typical ten slipper pump the spacing from the end of the constant tangent arc to the opening of the inlet port is nominally ten degrees or approximately one times the slipper arcuate surface interface to the cam bore. Further, the end of the inlet port termination point matched with the arcuate contour of the pumping bore wall assures that each slipper will return to its corresponding driving slot before the inlet port openings are terminated when one full slipper arcuate width enters the constant working arc. The inlet port is extended from 25°, assuming a zero degree datum, to 76°, thereby providing a lengthened arc. There is thus provided an arrangement which negates explosive turbulence effects at the crossover point outlet-to-inlet, as well as improved noise and high speed durability characteristics for high pressure pumps having increased performance specifications.

3 Claims, 4 Drawing Figures

Fig-1
(PRIOR ART)
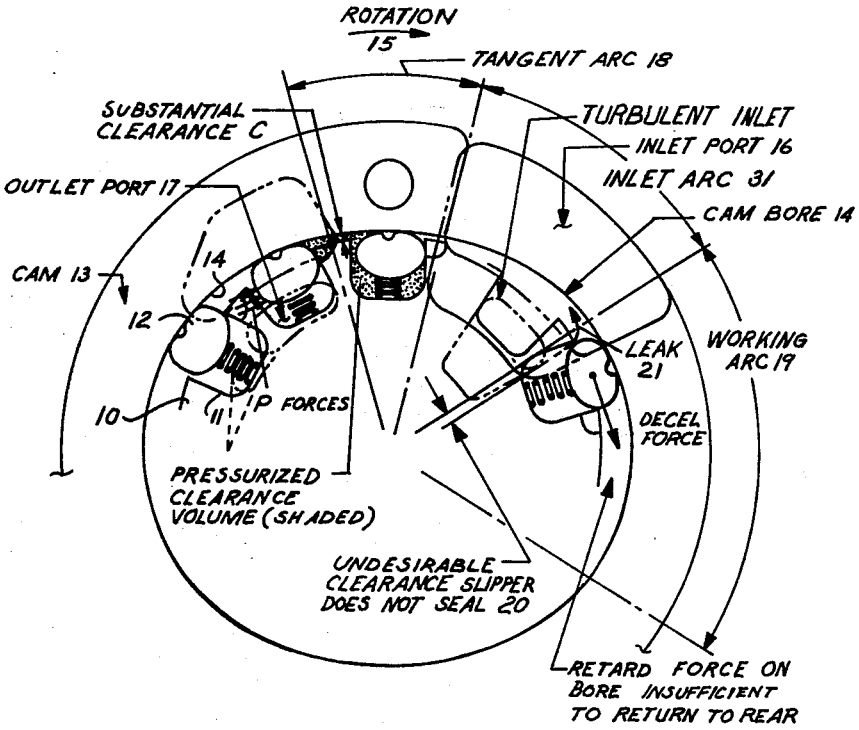
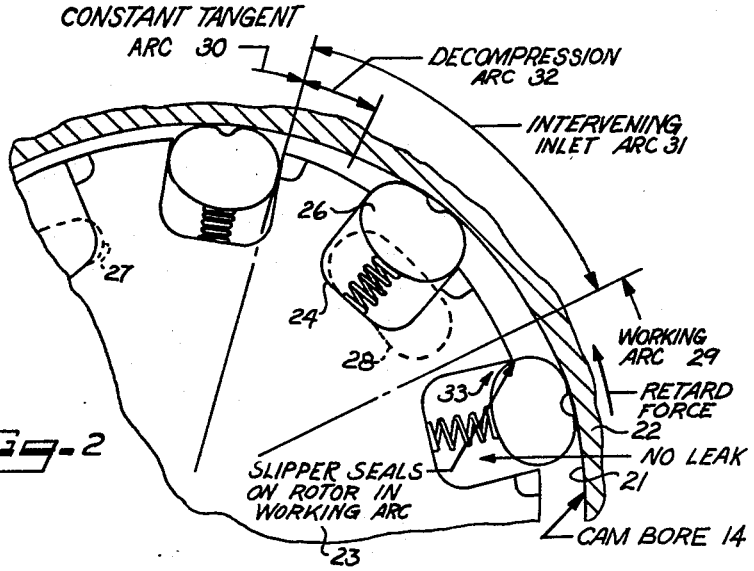
Fig-2

CONSTANT TANGENT ARC 30
DECOMPRESSION ARC 32

CONSTANT WORKING ARC 32
INTERVENING INLET ARC 31
OUTLET PORT
INLET PORT
UNDERSIDE OUTLET PORT
UNDERSIDE INLET PORT
CAM CONTOUR 40
180° REF.
0
15°
25°
70°
76°
32°
61½°
98½°
110°
123°
124¾°
165°
162°
164°
27
27a
28
28a
28b
28c
31
32
30

CONSTANT TANGENT ARC
INTERVENING INLET ARC 50
51
51a
51b
51c
52
52a
52b
52c
54
56
56c

OPTIMUM PORTING CONFIGURATION FOR A SLIPPER SEAL PUMP

BACKGROUND OF THE INVENTION

1. Field of the Invention

This invention relates exclusively to a species of pump, sometimes operable as a motor, known as a slipper vane pump. More specifically, the present invention relates to a specific construction of a slipper vane pump of the expanding chamber type wherein the tangent arc or crossover point is sealed by interposing a minimum of one slipper pumping vane in the tangent arc sealing position at all times.

2. The Prior Art

The slipper vane pump art is represented by such prior art as patents of William H. Livermore, Hubert M. Clark and Gilbert H. Drutchas. Typical is U.S. Pat. No. 3,200,752. Most of such prior art is centered on a form known to persons skilled in the art as a tangent arc seal. Such pump-type characteristically provides a rotor diameter seal at the crossover point between the outlet and inlet ports of a typical expanding chamber-type pumping unit.

The general concept of a so-called sllipper seal design wherein a minimum of one slipper is interposed into a tangent arc sealing position at all times has been described in the prior art. However, none of the pump constructions heretofore disclosed in the prior art are capable of meeting the noise and high speed durability characteristics vital to achieving the current order of sophistication required for high pressure hydraulic power applications, for example, for use as power steering pumps on dirigible vehicles. Due to the complexity of the noise-generating phenomena and the dynamic perturbations resulting from the virtual free-body action of the slipper pumping vane, concise positioning and specific geometric proportions are absolutely essential in order to achieve a pump which is satisfactory for widespread commercial usage and in order to achieve a status of commercial acceptability.

Those familiar with slipper pump art will appreciate the problems associated with achieving a quiet high tangent arc clearance pump design for automotive use, for example. Typically, since 1955, the designs of slipper pumps for power steering have not included a slipper seal design since no commercially quiet slipper pumps have existed. Early commercial slipper transmission pumps utilized the slipper seal approach, however, these pumps were of the round-bore type and operated up to a maximum pressure level of 250 psi, as contrasted with the performance specifications of contemporary power steering pump applications which may require delivered pump pressure of 1500 psi or greater. Ultimately, such prior art designs became obsolete due to the high level of noise.

In the pump construction exemplified by U.S. Pat. No. 3,200,752, which pump was produced in large quantities and used extensively in the automobile industry as a power steering pump, such pump did not require these parameters to maintain a commercial noise level since its clearance volume was limited by virture of being a tangent arc pump. However, heat rise, due to rotor rub, remains a characteristic problem to the artisan working in this field. Early experimenters in slipper seal art attempted to avoid such problems by maintaining a close tangent arc clearance. This has led to continuation of the current production problem syndrome of close rotor hit problems with high system heat rise due to rotor-cam rubbing attrition.

It will also be appreciated by those experienced in the slipper pump art that the configurations applicable to the conventional vane design or the vane roller are set apart from the needs of the slipper pumps. The former maintains a close fit vane-to-slot as low as 0.0002 nominally, virtually restricting any perceptible fore and aft motion in the rotor slot, while the roller vane utilizes a contoured slot that constrains the roller position fore and aft in the slot to a workable maximum.

On the other hand, the slipper pumping vane, a substantially rectangular body, is accelerated forward in the slot clearance by the action of high pressure outlet fluid and the decreased pressure state on the fore of the slipper as the rotor turns through the tangent arc from outlet to inlet. If not controlled, the slipper pumping vane rapidly checks to the front rotor slot which presents a high pressure level to its rearward trailing trapped annulus. Large or excessive clearance thus results in comparatively large pressurized oil pressure parcels entering the inlet port through the clearance volume causing virtual explosive turbulence in the inlet. The turbulent eddys produce an outward token noise, and, in turn, act to prevent the proper fill under the slipper traversing through the inlet port.

It appears from our studies that the slipper action with low centrifugal force and the lack of solid oil is not conducive to forcing the slipper to reseat against its driving edge. Failure to do so, prevents the slipper from effecting a proper seal in the working arc, thus, causing a flow pulse and a perceptible pressure peaking at the point of inlet port closure, since some high pressure oil can escape to the inlet and thus add another source of noise to the pump. Since the relative time span of each of the dynamic actions of the slipper pumping vane are finitely minimal time frames, it is difficult to provide control means that do not under or over compensate the slipper pumping vane action.

SUMMARY OF THE INVENTION

This invention, through its conceptual characteristics establishes a basis for relating the fundamental dynamics to certain geometric relationships permitting a substantially and unique effective control of the problems described hereinabove.

First of all, by the present invention, we have negated the explosive turbulence effects at the crossover point outlet-to-inlet resulting from the high pressure clearance volume, permitting oil to remain at the bottom of the slipper tending to reduce cavitation and climinating the inlet port resonance noise often manifest in the form of a growling noise on a dirigible vehicle such as an automobile. Such negation is accomplished by providing a critical spacing which, in a typical ten slipper porting configuration requires the spacing from the end of the constant tangent decompression arc to the opening of the inlet port to be nominally 10° within upper and lower limits of 1½°, or approximately one times the slipper arcuate surface interface to the cam bore.

It is further contemplated by the present invention that the decompression arc geometry termination point coupled with the end of the inlet port termination point on the port plate matches with the arcuate contour of the cam or pumping bore, constitutes a means for assuring that the slipper pumping vane will return to its corresponding driving slot before the inlet port openings are terminated when one full slipper arcuate width enters the constant working arc.

Further, a lengthened inlet arc is provided by starting the inlet port from 25° to 76°, using a reference datum of zero corresponding to top dead center or the middle of the tangent decompression arc, thereby affording a lengthened arc which permits a more gradual linear deceleration, which reduces cam bore wear and gross cavitational effects.

Other specifics of the optimum porting configuration will be manifest to those versed in the art upon making reference to the detailed description which is set forth in conjunction with the exemplary drawing figures presented as a part of this disclosure.

BRIEF DESCRIPTION OF THE DRAWINGS

FIG. 1 is a somewhat schematic view showing a pump of the prior art and illustrating some of the specific problems solved in accordance with the present disclosure.

FIG. 2 is a veiw generally similar to FIG. 1 but illustrating a pump embodying the general principles of the present invention.

BRIEF DESCRIPTION OF THE PREFERRED EMBODIMENT

Figure 3:
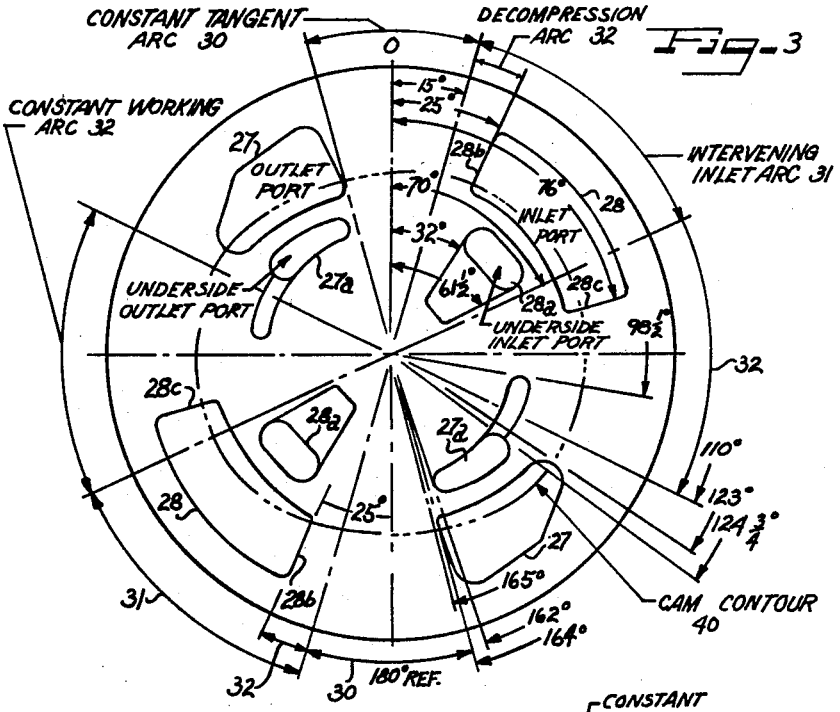
FIG. 3 is a diagrammatic representation of a pressure plate assembly utilizing the specific features of the present invention and illustrating the concept of the inventive improvements herein disclosed.

Referring, first of all, to the prior art arrangement of FIG. 1, it will be noted there is provided a pump utilizing a rotor 10 and having a plurality of peripheral slots 11 each carrying a slipper-type pumping vane 12. The slipper-type pumping vanes are of the type which are generally rectangular in section and which are carried in the slots 11 in such a manner that they are free to move radially and to rock angularly in following the adjoining contoured pumping bore wall, which pumping bore wall may be conveniently provided by a cam ring 13, the pumping bore wall being herein designated at 14.

As shown in FIG. 1, a porting plate means is provided wherein an inlet port is included at 16 and an outlet port at 17. The pump is of the type having a tangent arc 18 and a working arc 19. It will be noted there is a substantial clearance designated at C between the tangent arc 18 and the rotor 10. Further, it will be noted that as the rotor rotates in a clockwise direction indicated by the arrow 15, there are substantial pressure forces P acting on each respective slipper pumping vane 12. Thus, because of the pressurized clearance volume which is indicated in FIG. 1 by light crosshatching, turbulence will occur at the area of the inlet port 16. It will be noted there is indicated a retard force on the bore which is insufficient to return the slipper to its corresponding slot. Thus, there is undesirable clearance indicated at 20 resulting in a leak 21 designated by the arrow which further contributes to the turbulence in the inlet area of the port.

Referring now to FIG. 2, it is contemplated by the present invention to provide a porting plate and pumping chamber combination having optimum slipper seal porting configuration. Thus, a cam bore 21 is provided in a cam ring 22 and a rotor 23 having peripheral slots 24 carries a corresponding plurality of slipper pumping vanes 26. Porting plate means are provided having an outlet port 27 and an inlet port 28. Further, there is a working arc 29 and a tangent art 30. Interposed between the working arc and the tangent arc is an intervening inlet arc 31. However, the inlet arc is disposed with respect to the inlet port 28 in such a manner that there is at the beginning of the inlet arc a specifically provided decompression portion 32 in the porting geometry.

Further, the slippers 26 will seal on the rotor in the working arc and as a result as designated by the arrow 33, there will be no leak to interfere with the operation of the pump.

More specifically, the porting arrangements are illustrated in FIG. 3 wherein there is shown a pressure plate which could constitute a lower pressure plate used in conjunction with a rotating group of pump elements of the type disclosed in pending U.S. application for patent Ser. No. 314,861 filed Dec. 13, 1972, now U.S. Pat. No. 3,797,977, in the name of Robert E. Carlson entitled "Slipper-Type Pumping Element for a Pump or Motor." That application discloses and claims a slipper seal rotor and slipper relationship wherein the slipper has an optimum configuration and is particularly suited for utilization in the pump of the present invention. Since all of the normal pump construction would be similar to that disclosure, the details are not believed to be necessary to a proper understanding of the principles of the present invention. Thus, as shown on FIG. 1, a cam contour is shown in a phantom line and is indicated at 40 which cam contour prescribes the pumping wall bore of a double-lobed pump. For purposes of definition and disclosure, all angular dimensions are located from a datum of zero degrees corresponding to top dead center, a vertical axis of 0–180 being provided on FIG. 3 to dispose the opposite lobes of the cam contour on opposite sides of the axis.

For purposes of clarity the term arc will hereafter refer to cam arcs referenced from zero top center.

As shown by legend and reference numerals, there is a constant tangent acr 30 and a constant working arc 32, the intervening inlet arc being shown at 31.

In the particular arrangement of FIG. 3, the double-lobed arrangement includes a pair of constant tangent arcs, one of the constant tangent arcs extending from 345° to 15° and the other extending from 165° to 195°.

There are also a pair of working arcs, extending respectively from 70° to 110° and from 250° to 290°.

Again, there are a pair of intervening inlet arcs from 15° to 70° and from 195° to 250°.

Lastly, there are a pair of outlet arcs extending respectively from 110° to 165° and from 290° to 345°.

The so-called decompression arc portion of the intervening inlet arc is disposed in a 10° segment at the beginning of the intervening inlet arc. In this regard, it has been discovered that the spacing represented by the arrangements of FIG. 3 are critical and it will be understood that the proportions and designations of FIG. 3 represent a typical ten slipper porting configuration. Thus, the spacing for the end of the constant tangent arc 30 to the opening of the inlet port 28 is nominally 10° within upper and lower limits of plus and minus 1½°, or, approximately one times the slipper arcuate surface interface to the cam bore. There is thus provided a decompression arc and such arrangements negate the explosive turbulence effect at the crossover point outlet-to-inlet resulting from the high pressure clearance volume, permitting oil to remain at the bottom of the slipper, tending to reduce cavitation and eliminating the inlet port resonance noise often manifest in the form of a growl-like noise on a dirigible vehicle equipped with a power steering pump.

Referring further to FIG. 3, it will be noted that the inlet port 28 is disposed to communicate with the expansible chambers formed between adjoining pairs of slippers at the radially outwardly spaced portions of the pumping chamber.

Additionally, there may be provided underside inlet ports shown at 28*a* and which are arranged within the angular limitations of the outermost inlet port 28. Such underside inlet ports are disposed to communicate with the underside of the slippers opposite the slots 24 of the rotor 23.

Referencing to the port plate dimensions in FIG. 3, the inlet port 28 extends from 25°, as prescribed by the edge of the inlet 28*b* and extends to 76° as prescribed by the edge 28*c*. The oppositely disposed inlet port extends from 205° to 281°.

It has been discovered that the spacing relationship is so critical that the upper and lower limits of the decompression arc should be controlled within plus or minus 1½°, thereby to achieve the elimination of the explosive turbulence effect as noted.

The lengthened inlet arc and the length of the inlet port from 25° to 76° permits a more gradual linear deceleration, which reduces cam bore wear and the gross cavitational effects.

Assuming the provision of a ten slipper pump, it will be appreciated that the present invention contemplates that the decompression arc 32 geometry termination point, coupled with the end of the inlet port termination point 28*b* on the port plate matched with the arcuate contour of the cam constitutes a means for assuring that the slipper will return to the driving slot before the inlet port openings are terminated when one full slipper arcuate width enters the constant working arc 32.

Referring now to the outlet ports, it will be noted that there are also provided outer outlet ports 27 and inner or underside outlet ports 27*a*. The outlet ports are disposed to extend from 123° to 164° and from 303° to 344°.

Figure 4:
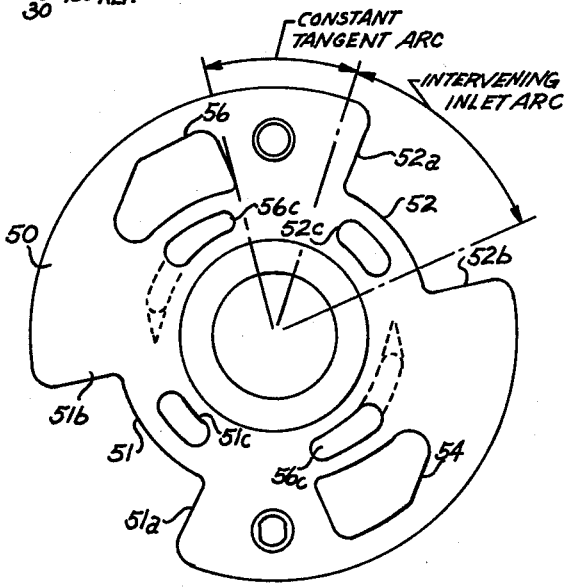
FIG. 4 is a view of a pressure plate showing port detail in a lower pressure plate which can be used in conjunction with an upper pressure plate having the characteristics of FIG. 3.

Referring now to FIG. 4, it will be appreciated that the lower pressure plate may be provided at 50 and wherein the inlet portions constitute notches 51 and 52 having angular limits 51*a* and 51*b* and 52*a* and 52*b* within the parametric limits already described in connection with the inlet ports 28, as shown in FIG. 3.

The plate 50 also has outlet ports 54 and 56, respectively, and it will be appreciated that there are both an outer set of ports and an inner set of ports, all of the inner set of ports being indicated by like reference numerals on the plate 50, but with the suffix *c*. Again, the critical spacing relationships are within the parametric limitations as already defined in connection with the description of FIG. 3.

There is thus provided, in accordance with the principles of the present invention a pump which successfully operates at high pressures and with increased efficiency and with an elimination of inlet port resonance noise with commercial operation and tangent arc clearances previously not attainable.

It should be understood that we wish to embody within the scope of the patent warranted hereon all such modifications as reasonably and properly come within the scope of our contribution to the art.

We claim as our invention:

1. In a pump of the expanding chamber type having pumping vanes carried in a slotted rotor and which vanes comprise slippers which move radially and rock angularly and slide along the adjoining bore wall of a pumping chamber, a spring located in each slot in said rotor and biasing the slipper in the slot radially outwardly into engagement with the bore wall, porting means adapted to be disposed adjacent the pumping chamber and defining an inlet port and an outlet port, cam means forming the pumping chamber bore wall, said bore wall having formed therein a contour providing:

(1) a constant radius tangent arc interposed between the outlet and inlet ports, (2) a constant radius working arc, (3) an intervening inlet arc of increasing radius between said constant tangent arc and said constant working arc, and (4) an outlet arc between said working arc and said tangent arc, said slippers being circumferentially spaced so that at least one slipper is located at all times in said constant tangent arc and in sealing engagement with said bore wall in said constant tangent arc to provide a seal between said outlet and inlet ports, the angular spacing from the constant tangent arc to the opening of the inlet port being in the order of approximately one times the slipper arcuate surface interface with the pump chamber bore wall, thereby to form a decompression arc portion, and said decompression arc portion being 10° plus or minus 1½°.

2. In a pump as defined in claim 1 wherein said inlet port is disposed to start 25° from top dead center corresponding to the center of said constant tangent arc and extending angularly from said starting point through an angular measurement of 51° to a termination point at 76°.

3. In a pump as defined in claim 2 wherein the corresponding intervening inlet arc is disposed to start at 15° from top dead center and extends through 70° and said decompression arc begins 15° from top dead center.

* * * * *